United States Patent [19]

Bodelson

[11] Patent Number: 4,925,442

[45] Date of Patent: May 15, 1990

[54] OPERATING SYSTEM FOR CENTRIFUGAL SEPARATOR

[75] Inventor: Berth Bodelson, Tullinge, Sweden

[73] Assignee: Alfa-Laval Separation AB, Tumba, Sweden

[21] Appl. No.: 346,949

[22] PCT Filed: Nov. 16, 1987

[86] PCT No.: PCT/SE87/00534

§ 371 Date: Apr. 14, 1989

§ 102(e) Date: Apr. 14, 1989

[87] PCT Pub. No.: WO88/03839

PCT Pub. Date: Jun. 2, 1988

[30] Foreign Application Priority Data

Nov. 17, 1986 [SE] Sweden ..... 8604907

[51] Int. Cl.[5] ..... B04B 3/08

[52] U.S. Cl. ..... 494/40; 494/27

[58] Field of Search ..... 494/38, 40, 48, 27, 494/28, 29, 23; 210/781, 782

[56] References Cited

U.S. PATENT DOCUMENTS

| | | | |
|---|---|---|---|
| 3,938,734 | 2/1976 | Wilke | 494/40 |
| 4,479,788 | 10/1984 | Kohlstette | 494/27 |
| 4,514,183 | 4/1985 | Kohlstette | 494/40 |
| 4,643,708 | 2/1987 | Stroucken | 494/40 |

FOREIGN PATENT DOCUMENTS 2172221 9/1986 United Kingdom .

*Primary Examiner*—Robert W. Jenkins

*Attorney, Agent, or Firm*—Davis Hoxie Faithful & Hapgood

[57] ABSTRACT

In a centrifugal rotor an annular slide (5) exposes its one side towards a separation chamber (7) and its opposite side towards an annular chamber (9). The slide (5) can be moved axially by radial displacement of the free liquid surface of liquid bodies in said chambers (7, 9).

According to the invention a radial displacement of a free liquid surface in said annular chamber (9) is accomplished without liquid being discharged from the same. Instead an axial movable additional slide (6) is used, which has an axial directed surface exposed into the annular chamber (9). By means of the additional slide liquid can be displaced in the annular chamber (9) radially outwards and inwards.

7 Claims, 1 Drawing Sheet

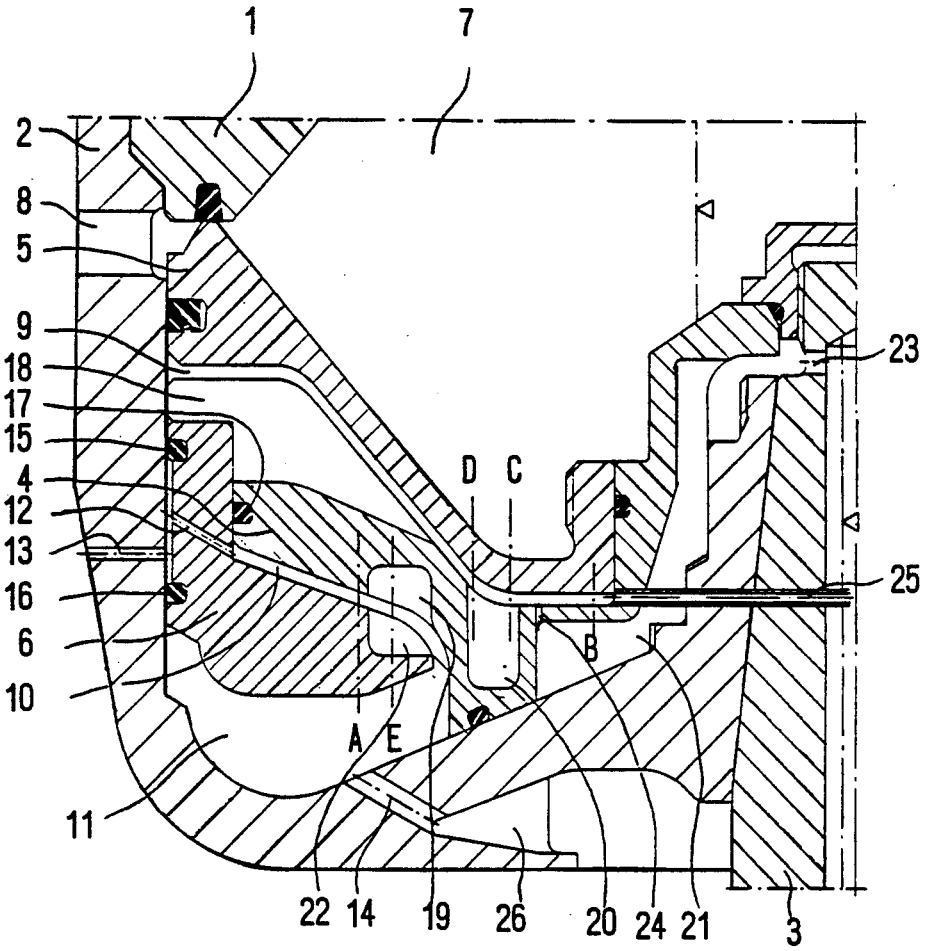
1
7
2
8
5
9
18
17
15
4
12
13
16
6
10
11
D
C
B
A
E
23
25
22
14
19
26
20
24
21
3

OPERATING SYSTEM FOR CENTRIFUGAL SEPARATOR

The present invention concerns a centrifugal separator having a rotor with a rotor body, an annular slide coaxially with the rotor body and movable axially relative to this, and an annular wall connected to the rotor body and forming together with the slide an annular chamber arranged to receive and upon rotation of the rotor retain a liquid for hydraulic influence on the slide. Furthermore, the rotor has an additional slide, which is arranged axially movable relative to the rotor body and the annular wall and which extends axially into and has an axially directed surface in a radially outer part of the annular chamber.

In centrifugal separators of this kind the annular slide generally is used for opening and closing of openings at the circumference of the centrifuge rotor, e.g. openings constituting peripheral outlets from a separation chamber in the rotor. A centrifugal separator of this kind is shown in GB No. 2.172.221, for instance, at which said additional slide is arranged for intermittently opening of a peripheral outlet from the annular chamber during operation of the centrifuge rotor, so that all or a part of the amount of liquid present in the chamber can be discharged.

When liquid is discharged out of the annular chamber, the free liquid surface therein is moved radially outwards, while the axial pressure of the liquid on the slide decreases. As a result of the fact that process liquid present inside the separation chamber acts with a counter directed pressure on the slide, the slide will be moved axially to opening of the outlets of the separation chamber, when the pressure on the slide from the liquid in the annular chamber becomes less than the counter directed pressure from the process liquid. If the annular chamber is emptied completely of liquid, the slide will remain in a position, in which the outlets of the separation chamber are open. The separation chamber will then be emptied completely of its contents. If on the contrary only a part of the liquid in the annular chamber is discharged, the slide at first will be moved such that the outlets of the separation chamber are opened and thereafter be moved back to its closing position by the pressure of the liquid remaining in the annular chamber. Determining for the amount of process liquid leaving the separation chamber will thus be the amount of liquid discharged out of the annular chamber. Upon total as well as partial discharge of the separation chamber new liquid has to be supplied to the annular chamber as replacement for the liquid discharged out through the peripheral outlets.

A problem in centrifugal separators of this kind is to be able to precisely discharge during operation a certain amount of liquid out of the annular chamber, so that the liquid surface in this remains at a desired radial level. Only if so is done, it is possible to determine with a high accuracy the amount of process liquid which is to be discharged out of the separation chamber. In connection to this it should be mentioned that a central inflow of liquid into the annular chamber, which normally is maintained uninterrupted while liquid is leaving the chamber via the peripheral outlets, does not essentially influence on the level at which the liquid surface in the chamber stops at its movement radially outwards. The flow rate of the supply at the center of the rotor is only a fraction or a few per cent of the flow rate of the outflow through the peripheral outlets, meaning that possible disturbances in the supply has far less importance than disturbances in the outflow.

Another problem in centrifugal separators of the known kind is to discharge liquid out of the annular chamber quickly enough. A further problem is that the valve means used for the intermittent opening and closing of the outlets from the annular chamber are worn out during operation and demand regular service to be able to keep the outlets securely closed.

The object of the present invention is to provide a solution of the above mentioned problems.

This is possible according to the invention in a centrifugal separator of the initially defined kind which—instead of being provided with outlet openings from the annular chamber and means for intermittently opening and closing thereof—is equipped with sealing means arranged to seal between the additional slide and the rotor body and the annular wall, respectively, during axial movement of the additional slide, the additional slide being so designed that upon axial movement in the one direction it takes up an increasing and upon axial movement in the other direction it takes up a decreasing part of the volume of the annular chamber in order to displace liquid radially inwards and outwards, respectively, in the annular chamber.

Thanks to this invention there is no need for discharging liquid out of the annular chamber when the slide is to be brought into axial movement. Instead, only a radial movement outwards of a part of the liquid in the chamber and the free liquid surface therein is accomplished by means of the additional slide, whereby the axial liquid pressure against the annular slide decreases. When the liquid pressure against the slide is to be increased again, a reverse displacement of the liquid in the chamber is made by means of the additional slide so that the free liquid surface moves radially inwards.

In a centrifugal separator according to the invention it is possible to determine very precisely at which radial level the free liquid surface in the annular chamber will stop, when the additional slide moves axially a predetermined distance. In other words it is for instance possible to decide with a high accuracy and high security how much process liquid, which will remain in the separation chamber, when the annular slide has been brought to open and reclose the peripheral outlets of the separation chamber. The movement radially outwards of the liquid surface in the annular chamber can be executed very quickly because the arrangement according to the invention does not prescribe a flow of liquid through a number of narrow outlets from the chamber. Finally, the need of valve means for the opening and closing of such outlets from the chamber is avoided by the invention.

The invention is in the first place intended to be used in centrifugal separators in which the annular slide is arranged for the opening and closing of peripheral outlets from the separation chamber, and in this connection for partial discharge of the separation chamber. To avoid unnecessary length of the stroke of the additional slide this is preferably ring shaped and exposes an annular surface in the annular chamber. Hereby the additional slide can be given such a shape that in spite of a short stroke length it can displace a relatively large volume of liquid in the annular chamber.

In the following the invention will be described in more detail with reference to the accompanying drawing, which shows a preferred embodiment of the same.

On the drawing there is shown an axial section of a part of a centrifuge rotor with a rotor body consisting of an upper part 1 and a lower part 2. The parts 1 and 2 are kept together axially by means of a locking ring which is not shown in the drawing. The lower part 2 is connected to a vertical hollow driving shaft 3.

Inside the rotor body there is an annular intermediate wall 4 arranged coaxially with the rotor and connected to this at its center. Further inside the rotor body there is arranged two axially movable annular slides 5 and 6. The slide 5 is located between the intermediate wall 4 and the upper rotor part 1. At its radially outer edge the slide 5 in an upper position is arranged to sealingly abut against the rotor part 1. Between the rotor part 1 and the slide 5 there is formed a separation chamber 7. Radially outside the area for the abutment of the slide 5 against the rotor part 1, the rotor part 2 has a number of openings 8 distributed around the circumference of the rotor intended to serve as peripheral outlets from the separation chamber when the slide 5 is located in a lower position and a gap is at hand between the slide 5 and the rotor part 1. Between the slide 5 and the intermediate wall 4 there is formed an annular chamber 9.

The slide 6 is located between the intermediate wall 4 and the rotor part 2. A part of the slide 6 is essentially cylindrical and extends via a space between the rotor part 2 and the radially outermost part of the intermediate wall 4 into the chamber 9. The other part of the slide 6 is located in a chamber formed between the rotor part 2 and a radially outer part of the intermediate wall 4. The latter part of the slide 6 divides the said chamber into a first department 10 between the slide 6 and the intermediate wall 4 and a second department 11 between the slide 6 and the rotor part 2.

The first department 10 has a throttled peripheral outlet comprising a channel 12 through the slide 6 and a channel 13 through the rotor part 2.

The second department 11 has an inlet 14 for control liquid intended for axial movement of the slide 6.

Gaskets 15 and 16 are arranged to seal between the slide 6 and the surrounding part of the rotor part 2. A sealing 17 is arranged to seal between the intermediate wall 4 and the surrounding cylindrical part of the slide 6. At 18 there is shown a number of radially axially extending wings connected to the intermediate wall 4. Similar wings are supported by the intermediate wall 4 at 19, 20 and 21 and by the slide 6 at 22.

The wings 21 are located in a chamber which via a channel 23 communicates with the internal of the driving shaft 3, in which there is maintained a free liquid surface marked with a triangle. The intermediate wall 4 has at the radially outer part of the just mentioned space a number of axially through passing bore holes 24. Via the channel 23, the space around the wings 21, and the bore holes 24, the internal of the driving shaft 3 communicates with the annular chamber 9. Via a channel 25, which opens radially inside the liquid surface in the interior of the driving shaft 3, this interior of the driving shaft 3 also communicates directly with the radially innermost part of the chamber 9.

In communication with the control liquid inlet 14 the rotor body forms a radially inwards open groove 26, which can be charged with control liquid from a not shown supplying device.

The centrifugal rotor shown on the drawing functions in the following manner.

In connection with start of the centrifugal separator liquid is supplied to the rotor body via the hollow driving shaft 3, until the space around the wings 21 and the chamber 9 are filled with liquid. At the same time control liquid is supplied to the groove 26 until the department 11 is filled and a free liquid surface has been created at the same level with the radially inner edge of the slide 6. After such a supply of liquid the slides 5 and 6 are located in their upper positions as shown on the drawing.

When the slide 5 is to be moved to open the openings 8 in the rotor part 2, so that a part of the content in the separation chamber 7 is thrown out, an additional control liquid is supplied to the groove 26 during a predetermined time period. Since the department 11 already is filled with liquid, control liquid flows over into the department 10 via the radially inner edge of the slide 6, which serves as an overflow outlet for the department 11. The department 10 will now successively be filled with liquid, provided less liquid leaves the department 10 through the outlet 12, 13 than is supplied to the groove 26. When the free liquid surface in the department 10 has reached radially into a level A, the slide 6 is pressed downwards by the liquid pressure in the department 10 and the chamber 9. The radially outer cylindrical part of the slide 6, which is located in the chamber 9 and taking up a part of the volume of this, is then pushed out of the chamber 9 leaving an increasing space therein, which successively is filled with liquid from other parts of the chamber 9. Hereby most of the liquid in the chamber 9 is displaced rapidly radially outwards and when a free liquid surface in the chamber 9 has reached radially out to a level B, the liquid pressure against the slide 5 becomes too low to keep this in the shown position. The pressure from the process liquid in the separation chamber 7 thus presses the slide 5 downwards, so that the openings 8 are opened and process liquid flows out.

During this course the liquid surface in the chamber 9 moves an additional bit radially outwards until the slide 6 has reached a lower end position. When the two slides 5 and 6 have reached their lower end positions, the liquid surface in the chamber 9 is located at a level C. During this time the liquid surface in the separation chamber 7 moves radially outwards until the liquid pressure against the slide 5 has become less than the counter directed pressure from the liquid in the chamber 9. The slide 5 is then pressed upwards again to its position shown on the drawing and the liquid surface in the chamber 9 is displaced to a level D.

In this stage the discharge of the department 10 via the outlet 12, 13 already has been going on for a while, and when the liquid level in the department 10 has reached out to a level E equivalence is at hand between the upwards directed and the downwards directed forces on the slide 6. Upon continuous drainage of the department 10 the liquid in the department 11 presses the slide 6 upwards against the influence by the pressure on the same from the liquid in the chamber 9 and the decreasing amount of liquid in the department 10.

Upon the return of the slide 6 to its position shown on the drawing it displaces all the time liquid in the chamber 9 radially inwards. At the same time the chamber 9 is charged with a small amount of new liquid via the bore holes 24 so that the liquid surface in the chamber 9 returns to its original position close to the center of the rotor.

In the embodiment of the invention shown in the drawing it is presumed that the slide 5 returns to its upper closing position without help of any returning (upwards directed) movement of the slide 6. The department 10 thus can be permitted to be emptied relatively slowly. Further, there is presumed that a relatively small amount of new liquid is applied to the chamber 9 via the bore holes 24 while the liquid pressure in the chamber 9 permits such a supply of liquid. To avoid that a too heavy influence on the displacement of the liquid level radially outwards in the chamber 9 of the liquid amount being displaced by the slide 5 when it moves downwards (in opening direction), there has been formed an extra space radially between the levels C and D in connection with the chamber 9. This extra space consists of an annular recess in the intermediate wall 4, in which the above mentioned wings 20 are located.

To accomplish a corresponding limited movement of the liquid surface in the department 10 as a result of the movement of the slide 6, annular recesses have been formed in right across each other located parts of the intermediate wall 4 and the slide 6. In these recesses the above mentioned wings 19 and 23 are placed.

I claim:

1. In a centrifugal separator having a rotor with an axis and a rotor body, an annular slide (5) coaxial with the rotor body and axially movable relative to said rotor body, an annular wall (4) connected to the rotor body and forming an annular chamber (9) with the slide (5), means for furnishing liquid to said annular chamber for exerting hydraulic pressure on said slide (5), said chamber (9) being adapted to retain said liquid upon rotation of the rotor, and an additional slide (6), axially movable relative to the rotor body and the annular wall (4), said additional slide (6) extending into the annular chamber (9) and having an axially facing surface in a radially outer part of the annular chamber (9), the improvement which comprises sealing means (15, 17) between the additional slide (6) and the rotor body and between the additional slide (6) and the annular wall (4), for sealing during axial movement of the additional slide (6), said additional slide (6) having a configuration such that during axial movement in one direction it takes up an increasing volume of the annular chamber (9) and during axial movement in the other direction it takes up a decreasing volume of said chamber (9), thereby displacing liquid radially inwardly and outwardly, respectively, in said chamber (9).

2. Centrifugal separator according to claim 1, wherein the additional slide (6) is ring shaped and exposes an annular surface in said chamber (9).

3. Centrifugal separator according to claim 2, wherein the additional slide (6) has an annular part located radially between a surrounding part (2) of the rotor body and a radially outer part of the annular wall (4), said sealing means (15, 17) being arranged between the annular wall (4) and the additional slide (6) and between the additional slide (6) and said part (2) of the rotor body.

4. Centrifugal separator according to claim 2 or 3, wherein the additional slide (6) forms together with the annular wall a first department (10) arranged to receive and retain liquid for hydraulic influence on the additional slide (6) in said second direction.

5. Centrifugal separator according to claim 4, wherein forms together with the rotor body a second department (11) arranged to receive and to retain liquid for hydraulic influence on the additional slide (6) in said one direction.

6. Centrifugal separator according to claim 1 in which a rotor forms a separation chamber (7) and peripheral outlets (8) from the same for a separated product, and wherein said annular slide (5) is arranged for closing and intermittently opening said outlet from the separation chamber (7).

7. Centrifugal separator according to claim 6, wherein the annular slide (5) forms an essential part of an axial movable end wall in the separation chamber (7).

* * * * *

UNITED STATES PATENT AND TRADEMARK OFFICE

CERTIFICATE OF CORRECTION

PATENT NO. : 4,925,442

DATED : May 15, 1990

INVENTOR(S) : Berth Bodelson

It is certified that error appears in the above-identified patent and that said Letters Patent is hereby corrected as shown below:

Col. 6, line 26, after "wherein" insert

--the additional slide (6)--

Signed and Sealed this

Third Day of September, 1991

*Attest:*

HARRY F. MANBECK, JR.

*Attesting Officer*

*Commissioner of Patents and Trademarks*